US007089719B2

(12) United States Patent
Owens

(10) Patent No.: US 7,089,719 B2
(45) Date of Patent: Aug. 15, 2006

(54) HORSE BROWBAND

(76) Inventor: Trudy A. Owens, 19368 Noll Rd. NE., Poulsbo, WA (US) 98370

( * ) Notice: Subject to any disclaimer, the term of this patent is extended or adjusted under 35 U.S.C. 154(b) by 55 days.

(21) Appl. No.: 10/994,755

(22) Filed: Nov. 22, 2004

(65) Prior Publication Data

US 2006/0107625 A1 May 25, 2006

(51) Int. Cl.
*B68B 1/04* (2006.01)
*A62B 35/00* (2006.01)

(52) U.S. Cl. ..... 54/12; 119/858

(58) Field of Classification Search ..... 54/12; 119/792, 856, 858; D11/6, 8, 11; 63/3, 3.1
See application file for complete search history.

(56) References Cited

U.S. PATENT DOCUMENTS 337,732 A * 3/1886 Beebee ..... 54/12
405,307 A * 6/1889 Flues ..... 54/12
473,079 A * 4/1892 Pfiffner ..... 54/12
807,426 A * 12/1905 Fisher ..... 54/12
D112,001 S * 11/1938 Solomon ..... D11/11
2,378,755 A * 6/1945 Dowling ..... D11/11
3,765,376 A * 10/1973 Higgins ..... 119/858
5,528,909 A * 6/1996 Tonakawa ..... 63/3
5,713,218 A * 2/1998 McCabe ..... 63/3.1
5,865,148 A * 2/1999 Aguirre et al. ..... 119/856
6,094,939 A * 8/2000 Gavello ..... 63/3
6,748,903 B1 * 6/2004 Price, III et al. ..... 119/858

* cited by examiner

*Primary Examiner*—Teri Pham Luu
*Assistant Examiner*—Elizabeth Shaw
(74) *Attorney, Agent, or Firm*—Andrew L. Ney

(57) ABSTRACT

A horse browband having a plurality of decorative components adhesively attached to a flexible band with lengths of thread extending through the decorative components from one end of the flexible band to the opposite end of the flexible band to provide added protection against the decorative components falling off the flexible band when, for example, the adhesive fails.

12 Claims, 2 Drawing Sheets

HORSE BROWBAND

FIELD OF THE INVENTION

The present invention relates, in general, to horse bridles and, in particular, to the browband portion of a horse bridle.

BACKGROUND OF THE INVENTION

Horse owners "dress" their horses for horse show competitions with decorative equipment (e.g., bridles and saddles) because of the widespread belief that the attractive appearance of the horse enhances the chances of success in the competition. One such equipment part is the browband portion of a horse bridle.

Many, many decorative horse browbands are available today. In one popular style of such browbands, glass beads or semi precious gems are adhesively attached to a leather band.

In general, such browbands that have decorative components adhesively attached to a leather band have a major shortcoming. Because the browband must be flexible to adapt to the curvature of the brow of the horse, there is a tendency for the decorative components to loosen or fall off the leather band when the adhesive fails as the browband flexes. The results is a browband of poor appearance (i.e., irregularly spaced voids along the leather band) and the loss of valuable items (i.e., decorative components lost in turf).

SUMMARY OF THE INVENTION

A horse browband, constructed in accordance with the present invention, includes a flexible band having first and second loops at first and second ends, respectively, of the flexible band with each of the loops adapted to receive a bridle strap. A plurality of decorative components is adhesively attached to the flexible band along the length of the flexible band. Each of the decorative components has a first through hole extending parallel to the length of the flexible band and aligned with the first through hole of an adjacent decorative component and a second through hole extending parallel to the length of the flexible band and aligned with the second through hole of an adjacent decorative component. A first length of thread extends from the first end of the flexible band through the first through holes of the decorative components to the second end of the flexible band and a second length of thread extending from the first end of the flexible band through the second through holes of the decorative components to the second end of the flexible band.

DETAILED DESCRIPTION OF THE INVENTION

Figure 1:
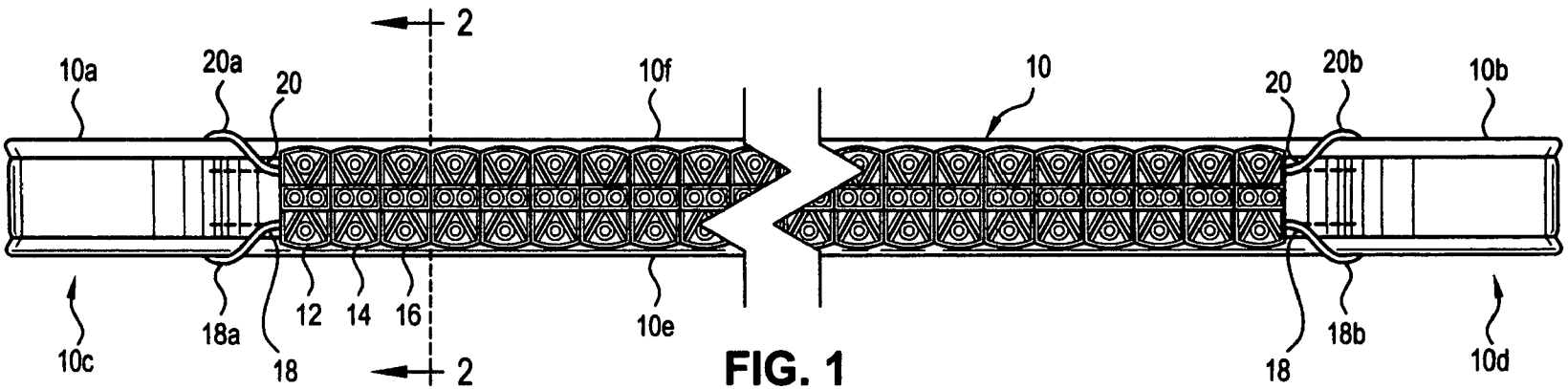
FIG. 1 is a top view of a preferred embodiment of a horse browband constructed in accordance with the present invention.
Figure 2:
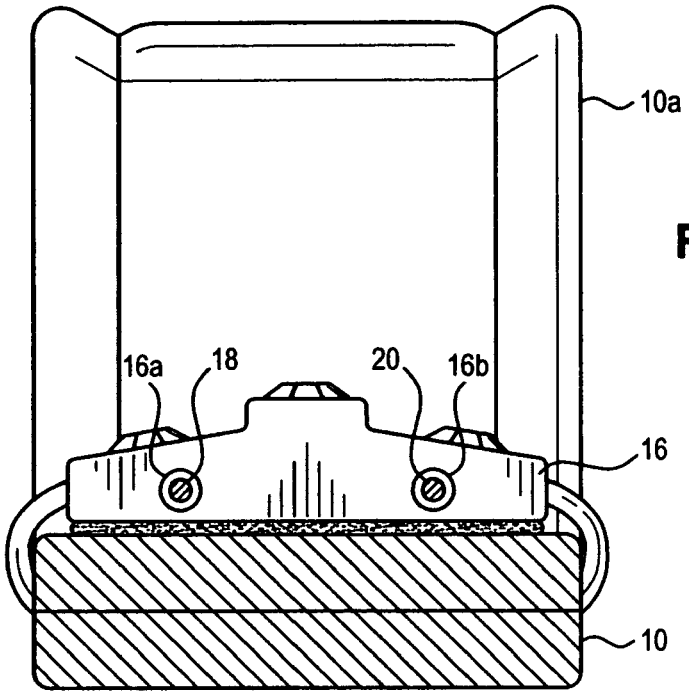
FIG. 2 is a sectional view of the FIG. 1 horse browband taken along line 2—2 of FIG. 1.
Figure 3:
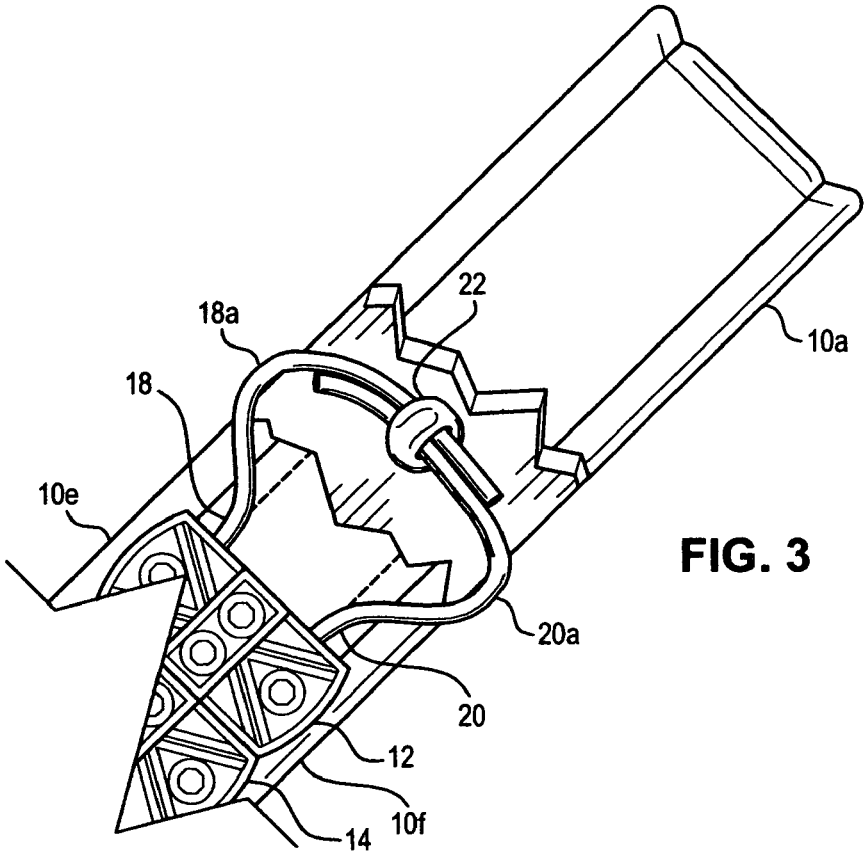
FIG. 3 is a top view, partially broken away, of an end portion of the FIG. 1 horse browband.

Referring to FIGS. 1, 2, and 3, a horse browband, constructed in accordance with the present invention, includes a flexible band 10 having first and second loops 10*a* and 10*b* at first and second ends 10*c* and 10*d*, respectively, of the flexible band. Each loop 10*a* and 10*b* is adapted to receive a bridle strap in the usual manner. Flexible band 10 preferably is leather.

A horse browband, constructed in accordance with the present invention, also includes a plurality of decorative components 12, 14, 16 . . . that is adhesively attached to flexible leather band 10 along the length of the flexible leather band. As shown most clearly in FIG. 2, each decorative component (e.g., 16) has a first through hole (e.g., 16*a*) extending parallel to the length of flexible leather band 10 and aligned with the first through hole of an adjacent decorative component and a second through hole (e.g., 16*b*) extending parallel to the length of the flexible leather band and aligned with the second through hole of an adjacent decorative component.

A horse browband, constructed in accordance with the present invention, further includes a first length of thread 18 extending from the first end 10*c* of flexible leather band 10 through the first through holes (e.g., 16*a*) of decorative components (e.g., 12, 14, 16) to the second end 10*d* of the flexible leather band and a second length of thread 20 extending from the first end 10*c* of the flexible leather band through the second through holes (e.g., 16*b*) of the decorative components to the second end of the flexible leather band. The lengths of thread 18 and 20 should be sufficiently strong to withstand the flexing of flexible leather band 10 and not break when the flexible leather band flexes. The first length of thread 18 and the second length of thread 20 can be metallic wire.

A first end 18*a* of the first length of thread 18 is anchored to flexible leather band 10 at the first end 10*c* of the flexible leather band and a first end 20*a* of the second length of thread 20 is anchored to the flexible leather band at the first end 10*c* of the flexible leather band. A second end 18*b* of the first length of thread 18 is anchored to flexible leather band 10 at the second end 10*d* of the flexible leather band and a second end 20*b* of the second length of thread 20 is anchored to the flexible leather band at the second end 10*d* of the flexible leather band.

The first length of thread 18 and the second length of thread 20 can be separate pieces of thread or a single piece of thread.

When the first length of thread 18 and the second length of thread 20 are a single piece of thread:

(a) the first end 18*a* of the single piece of thread is in the first loop 10*a* of flexible leather band 10 and extends transverse to the length of the flexible leather band to a first lateral edge 10*e* of the flexible leather band, (b) the single piece of thread extends from the first loop 10*a* of flexible leather band 10 through the first through holes (e.g., 16*a*) of the decorative components (e.g., 12, 14, 16) to the second loop 10*b* of the flexible leather band, (c) the single piece of thread extends through the second loop 10*b* of flexible leather band 10, (d) the single piece of thread extends from the second loop 10*b* of flexible leather band 10 through the second through holes (e.g., 16*b*) of the decorative components (e.g., 16, 14, 12) to the first loop 10*a* of the flexible leather band, and (e) the second end 20*a* of the single length of thread extends from a second lateral edge 10*f* of flexible leather band 10 into the first loop 10*a* of the flexible leather band transverse to the length of the flexible leather band.

The free ends 18*a* and 20*a* of the single length of thread extend through a bead 22 that is crimped to secure together the free ends of the single length of thread.

When the first length of thread 18 and the second length of thread 20 are separate pieces:

(a) the first end 18*a* of the first length of thread 18 is in the first loop 10*a* of flexible leather band 10 and extends transverse to the length of the flexible leather band to a first lateral edge 10*e* of the flexible leather band, (b) the first end 20*a* of the second length of thread 20 is in the first loop 10*a* of flexible leather band 10 and extends transverse to the length of the flexible leather band to a second lateral edge 10*f* of the flexible leather band, (c) the second end 18*b* of the first length of thread 18 is in the second loop 10*b* of flexible leather band 10 and extends transverse to the length of the flexible leather band to the first lateral edge 10*e* of the flexible leather band, and (d) the second end 20*b* of the second length of thread 20 is in the second loop 10*b* of the flexible leather band 10 and extends transverse to the length of the flexible leather band to the second lateral edge 10*f* of flexible leather band.

The free ends 18*a*, 20*a* and 18*b*, 20*b* of the separate lengths of thread extend through beads, such as bead 22 shown in FIG. 3, that are crimped to secure together the free ends 18*a*, 20*a* and 18*b*, 20*b* of the separate lengths of thread.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. A horse browband comprising:

a flexible band having first and second loops at first and second ends, respectively, of said flexible band with each of said loops adapted to receive a bridle strap;

a plurality of decorative components adhesively attached to said flexible band along the length of said flexible band with each of said decorative components having (a) a first through hole extending parallel to the length of said flexible band and aligned with the first through hole of an adjacent decorative component, and (b) a second through hole extending parallel to the length of said flexible band and aligned with the second through hole of an adjacent decorative component; and a first length of thread extending from said first end of said flexible band through said first through holes of said decorative components to said second end of said flexible band and a second length of thread extending from said first end of said flexible band through said second through holes of said decorative components to said second end of said flexible band.

2. A horse browband according to claim 1 wherein said flexible band is leather.

3. A horse browband according to claim 2 wherein:

(a) a first end of said first length of thread is anchored to said flexible leather band at said first end of said flexible leather band, (b) a first end of said second length of thread is anchored to said flexible leather band at said first end of said flexible leather band, (c) a second end of said first length of thread is anchored to said flexible leather band at said second end of said flexible leather band, and (d) a second end of said second length of thread is anchored to said flexible leather band at said second end of said flexible leather band.

4. A horse browband according to claim 2 wherein:

(a) said first length of thread and said second length of thread are a single piece of thread, (b) said first end of said single piece of thread is in said first loop of said flexible leather band and extends transverse to the length of said flexible leather band to a first lateral edge of said flexible leather band, (c) said single piece of thread extends from said first loop of said flexible leather band through said first through holes of said decorative components to said second loop of said flexible leather band, (d) said single piece of thread extends through said second loop of said flexible leather band, (e) said single piece of thread extends from said second loop of said flexible leather band through said second through holes of said decorative components to said first loop of said flexible leather band, and (f) said second end of said single piece of thread extends from a second lateral edge of said flexible leather band into said first loop of said flexible leather band transverse to the length of said flexible band.

5. A browband according to claim 4 further including a crimped bead through which said first end of said single piece of thread extends and said second end of said single piece of thread extends.

6. A horse browband according to claim 2 wherein:

(a) said first length of thread and said second length of thread are separate pieces, (b) a first end of said first length of thread is in said first loop of said flexible leather band and extends transverse to the length of said flexible leather band to a first lateral edge of said flexible leather band, (c) a first end of said second length of thread is in said first loop of said flexible leather band and extends transverse to the length of said flexible leather band to a second lateral edge of said flexible leather band, (d) a second end of said first length of thread is in said second loop of said flexible leather band and extends transverse to the length of said flexible leather band to said first lateral edge of said flexible leather band, and (e) a second end of said second length of thread is in said second loop of said flexible leather band and extends transverse to the length of said flexible leather band to said second lateral edge of said flexible leather band.

7. A browband according to claim 6 further including:

(a) a first crimped bead through which said first end of said first length of thread extends and said first end of said second length of thread extends, and (b) a second crimped bead through which said second end of said first length of thread extends and said second end of said second length of thread extends.

8. A horse browband according to claim 2 wherein:

(a) said first length of metallic wire and said second length of metallic wire are separate pieces, (b) said first end of said first length of metallic wire is in said first loop of said flexible band and extends transverse to the length of said flexible band to a first lateral edge of said flexible band, (c) said first end of said second length of metallic wire is in said first loop of said flexible band and extends transverse to the length of said flexible band to a second lateral edge of said flexible band, (d) said second end of said first length of metallic wire is in said second loop of said flexible band and extends transverse to the length of said flexible band to said first lateral edge of said flexible band, and (e) said second end of said second length of metallic wire is in said second loop of said flexible band and extends transverse to the length of said flexible band to said first lateral edge of said flexible band.

9. A horse browband according to claim 1 wherein said first length of thread is a metallic wire and said second length of thread is a metallic wire.

10. A horse browband according to claim 9 wherein:

(a) a first end of said first length of metallic wire is anchored to said flexible band at said first end of said flexible band, (b) a first end of said second length of metallic wire is anchored to said flexible band at said first end of said flexible band, (c) a second end of said first length of metallic wire is anchored to said flexible band at said second end of said flexible band, and (d) a second end of said second length of metallic wire is anchored to said flexible band at said second end of said flexible band.

11. A horse browband according to claim 9 wherein:

(a) said first length of metallic wire and said second length of metallic wire are a single piece of metallic wire, (b) said first end of said single piece of metallic wire is in said first loop of said flexible band and extends transverse to the length of said flexible band to a first lateral edge of said flexible band, (c) said single piece of metallic wire extends from said first loop of said flexible band through said first through holes of said decorative components to said second loop of said flexible band, (d) said single piece of metallic wire extends through said second loop of said flexible band, (e) said single piece of metallic wire extends from said second loop of said flexible band through said second through holes of said decorative components to said first loop of said flexible band, and (f) said second end of said single piece of metallic wire extends from a second lateral edge of said flexible band into said first loop of said flexible band transverse to the length of said flexible band.

12. A horse browband according to claim 1 wherein:

(a) said flexible band is leather, and (b) said first length of thread is a metallic wire and said second length of thread is a metallic wire.

* * * * *